US008469350B1

(12) United States Patent
Liu

(10) Patent No.: US 8,469,350 B1
(45) Date of Patent: Jun. 25, 2013

(54) OFFICE MACHINE

(75) Inventor: Chin-Te Liu, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 13/607,327

(22) Filed: Sep. 7, 2012

(51) Int. Cl.
*B65H 5/00* (2006.01)
*B65H 5/22* (2006.01)

(52) U.S. Cl.
USPC ..... 271/3.01; 271/3.14; 271/264; 399/380; 358/496

(58) Field of Classification Search
USPC ..... 271/3.01, 3.14, 264; 399/215, 367, 399/379, 380; 358/496, 498
See application file for complete search history.

(56) References Cited

U.S. PATENT DOCUMENTS

| | | | | |
|---|---|---|---|---|
| 5,953,574 | A * | 9/1999 | Okada | 399/374 |
| 6,512,602 | B1 * | 1/2003 | Sheng et al. | 358/498 |
| 7,380,787 | B2 * | 6/2008 | Fukumura | 271/264 |
| 8,162,314 | B2 * | 4/2012 | Tanahashi et al. | 271/264 |
| 8,422,098 | B2 * | 4/2013 | Hamada et al. | 358/498 |
| 2009/0295062 | A1 * | 12/2009 | Sheng | 271/4.01 |
| 2010/0295233 | A1 * | 11/2010 | Kano | 271/3.14 |
| 2011/0109038 | A1 * | 5/2011 | Nishizawa et al. | 271/226 |

* cited by examiner

*Primary Examiner* — David H Bollinger

(57) ABSTRACT

An office machine includes a pedestal having an image-handling unit disposed in a top thereof and a passage guider, and an automatic document feeder capable of rotating between an open position exposing the image-handling unit and a closed position covering the image-handling unit. The automatic document feeder defines a passage for transmitting a document from upstream to downstream therethrough. A substantial middle part of the passage is opened to cooperate with the image-handling unit. A magnetic component is mounted to the automatic document feeder. The passage guider is pivoted to the top of the pedestal and near to a downstream side of the image-handling unit. The passage guider will rotate upward by the magnetic component to make a free end thereof for guiding the document when the cover is at the closed position.

5 Claims, 10 Drawing Sheets

OFFICE MACHINE

BACKGROUND OF THE INVENTION

1. Field of the Invention

The present invention generally relates to an office machine, and more particularly to an office machine capable of automatically transmitting a document thereinto and out therefrom.

2. The Related Art

Referring to FIG. 1 and FIG. 2, an office machine 100 capable of automatically transmitting a document 18 thereinto and out therefrom includes a pedestal 10 with a guiding slope 19 fastened in a top face thereof and an image-handling unit 11 disposed in the top face thereof, and an automatic document feeder 20 rotatably coupled with the pedestal 10 for transmitting the document 18 into and out of the office machine 100. The automatic document feeder 20 is capable of rotating between an open position exposing the image-handling unit 11 and a closed position covering the image-handling unit 11. The automatic document feeder 20 defines a passage 21 through which the document 18 is transmitted. A substantial middle part of the passage 21 is opened to cooperate with the image-handling unit 11. The guiding slope 19 is near to the downstream side of the image-handling unit 11 according to the direction of transmitting the document 18 in the passage 21, so as to guide the document 18 back to the passage 21 after it is handled by the image-handling unit 11.

However, in use, improper operations often occur, such as too loose or too tight cooperation of the automatic document feeder 20 and the pedestal 10. Referring to FIG. 3 and FIG. 4, because the guiding slope 19 is immovable in the top of the pedestal 10, the too loose or too tight cooperation of the automatic document feeder 20 and the pedestal 10 may make the guiding slope 19 fail to guide the document 18 to normally be transmitted in the passage 21.

As shown in FIG. 3, a peak 19*a* of the guiding slope 19 is far away from the passage 21 and below a lower inner sidewall 242 of the passage 21 when the too loose cooperation happens between the automatic document feeder 20 and the pedestal 10. As a result, the handled document 18 deviates from the passage 21 and is blocked by the automatic document feeder 20. As shown in FIG. 4, the peak 19*a* of the guiding slope 19 abuts against an upper inner sidewall 241 of the passage 21 when the too tight cooperation happens between the automatic document feeder 20 and the pedestal 10. As a result, the handled document 18 is stuck and fails to be transmitted out. Therefore, an office machine capable of overcoming the foregoing problems is required.

SUMMARY OF THE INVENTION

An objective of the present invention is to provide an office machine capable of automatically transmitting a document thereinto and out therefrom. The office machine includes a pedestal and an automatic document feeder.

The pedestal includes an image-handling unit and a passage guider made of magnetic material. The image-handling unit is disposed in a top of the pedestal and exposed out of a top face of the pedestal for handling the document. The passage guider is pivoted to the top face of the pedestal. The automatic document feeder is rotatably coupled with the pedestal and capable of rotating between an open position exposing the image-handling unit and a closed position covering the image-handling unit. The automatic document feeder defines a passage which includes an entering passage, an operating passage and an exiting passage connected in sequence from upstream to downstream according to the direction of transmitting the document in the passage. The operating passage is formed between the automatic document feeder and the image-handling unit. A magnetic component is mounted to the automatic document feeder.

A pivoted end of the passage guider is pivoted near to a downstream side of the image-handling unit. When the automatic document feeder is at the closed position, the passage guider rotates upward according to the magnetic attraction of the magnetic component to make a free end thereof project into the passage and apart located between an upper inner sidewall and a lower inner sidewall of the entrance of the exiting passage so as to guide the handled document into the exiting passage. The passage guider rotates downward against the pedestal when the automatic document feeder is at the open position to set free the passage guider from the magnetic component.

As described above, in use, the height of the passage guider can be adjusted automatically according to the position of the automatic document feeder by virtue of the magnetic attraction of the magnetic component, so as to ensure the free end of the passage guider always apart between the upper inner sidewall and the lower inner sidewall of the entrance of the exiting passage. So, the document can be guided into the exiting passage smoothly by the passage guider.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
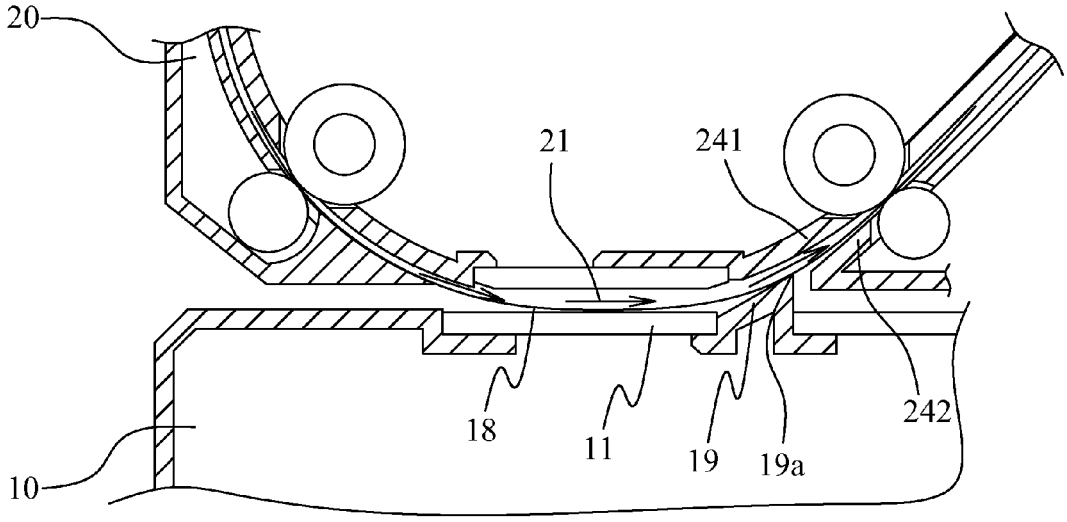
FIG. 1 (Prior Art)
FIG. 1 shows a partially sectional view of a common office machine.
Figure 2:
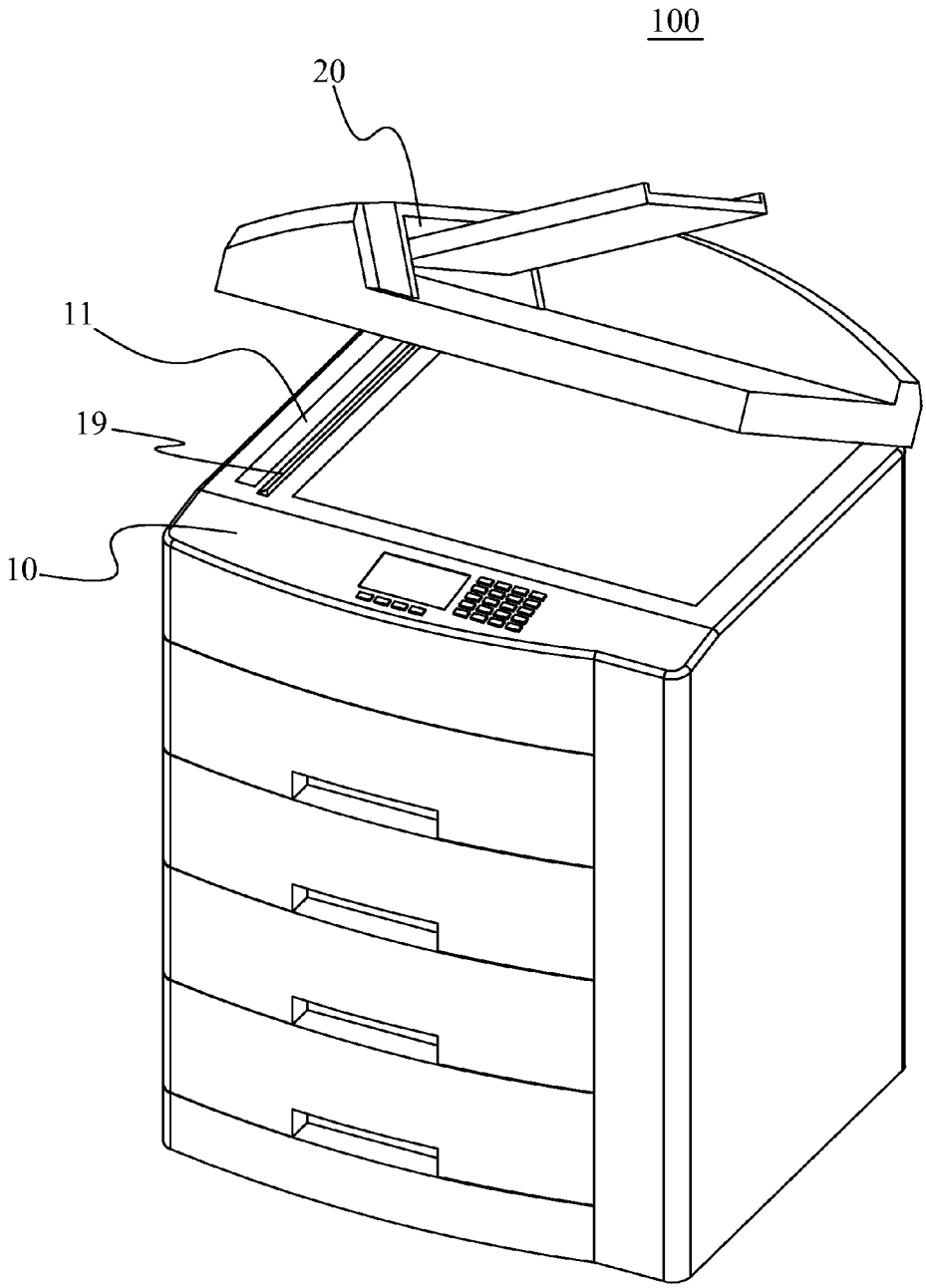
FIG. 2 (Prior Art)
FIG. 2 is a perspective view of the office machine shown in FIG. 1.
Figure 3:
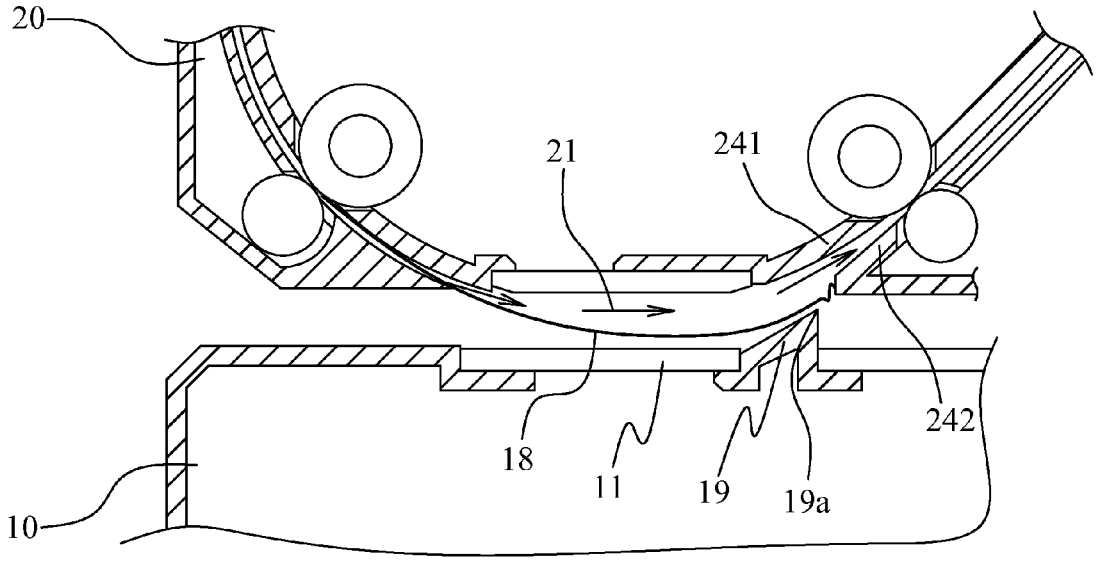
FIG. 3 (Prior Art)
FIG. 3 and FIG. 4 show abnormal working conditions of the office machine of FIG. 1.
Figure 4:
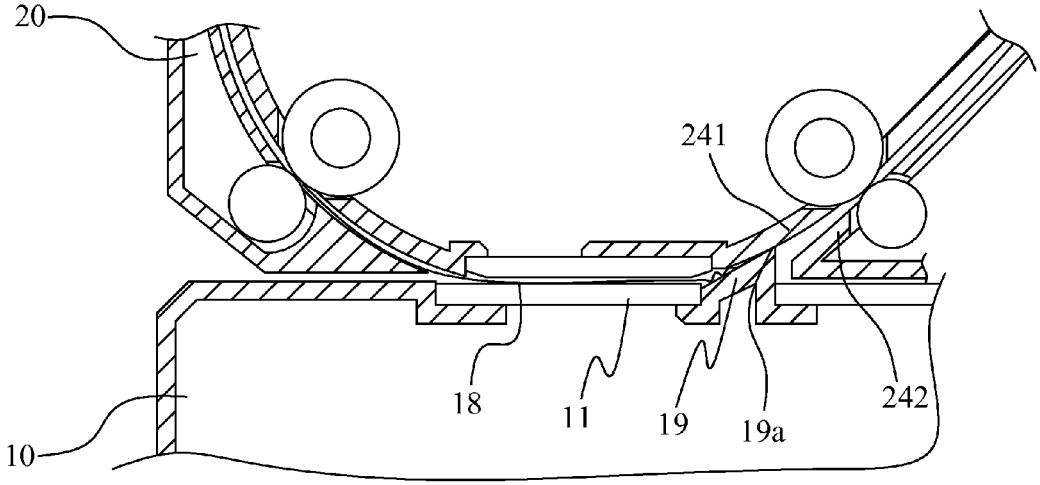
FIG. 4 (Prior Art)
Figure 5:
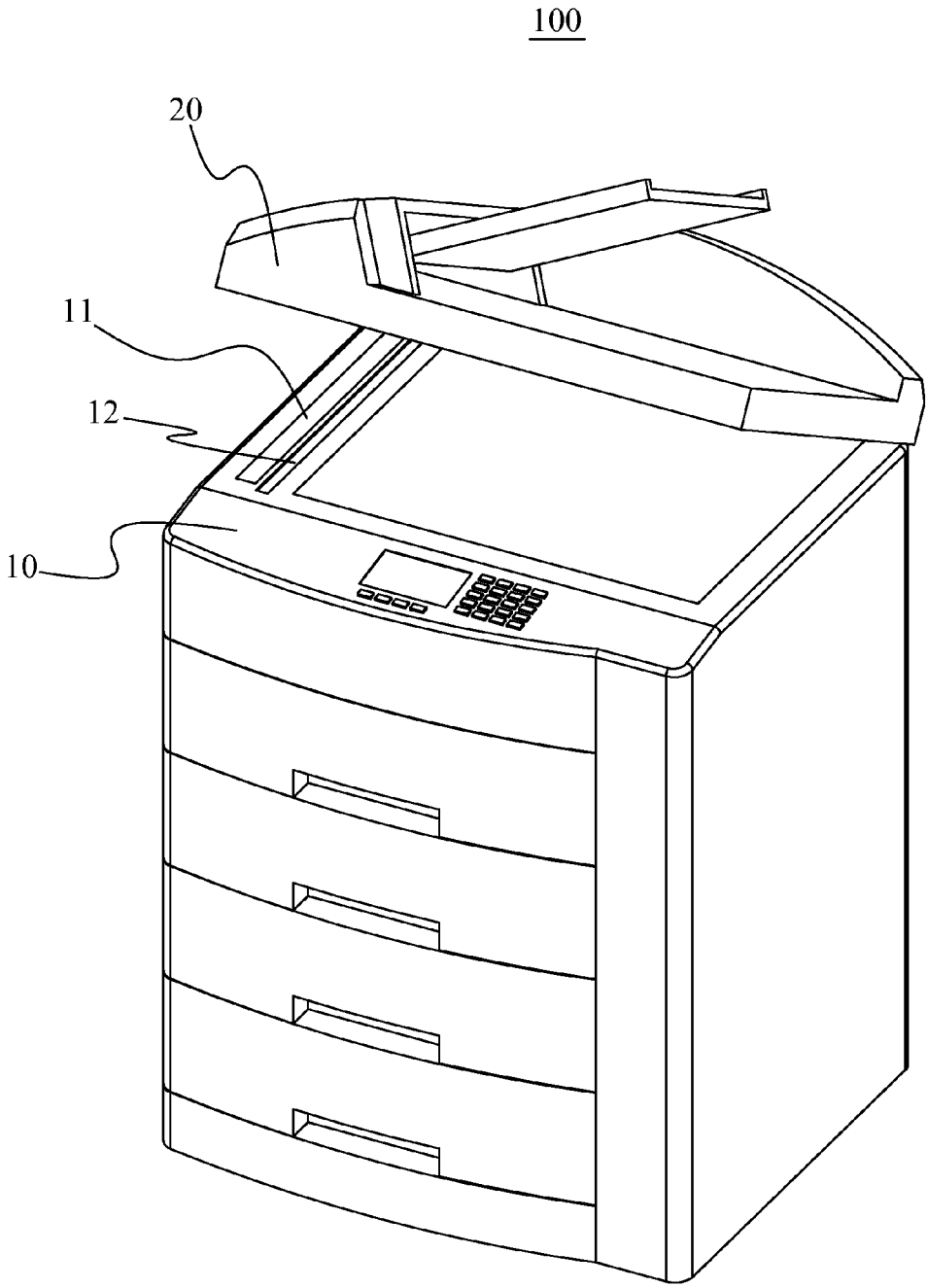
FIG. 5 shows a perspective view of an office machine according to an embodiment of the present invention, wherein an automatic document feeder of the office machine is at an open position.
Figure 6:
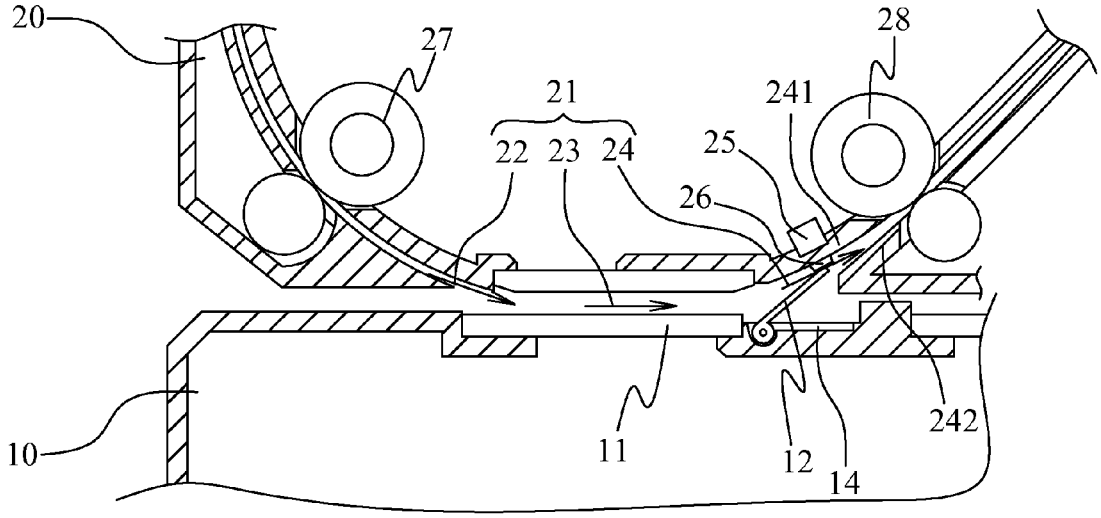
FIG. 6 shows a partially sectional view of the office machine of FIG. 5, wherein the automatic document feeder is at a closed position.
Figure 9:
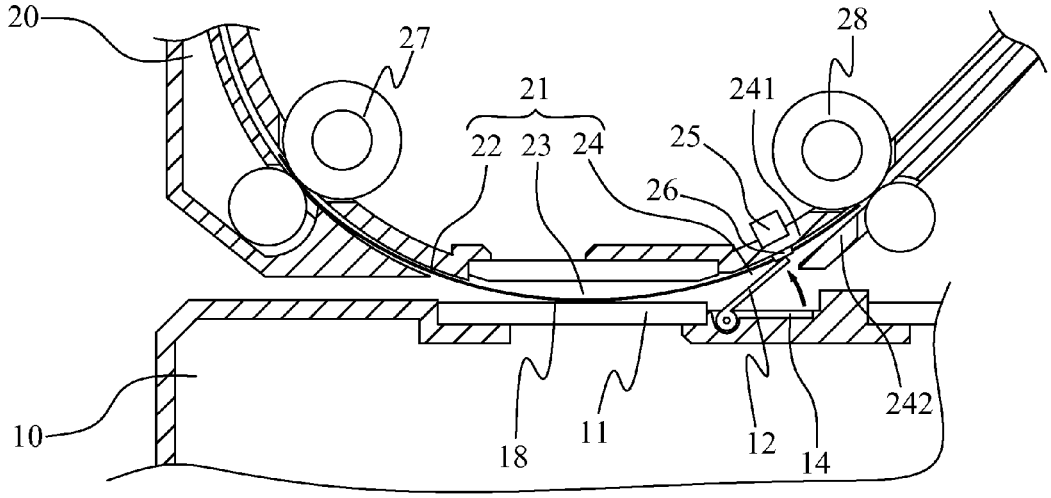
FIG. 9 is a schematic diagram showing that a handled document is guided into an exiting passage of the automatic document feeder of the office machine of FIG. 6.
Figure 10:
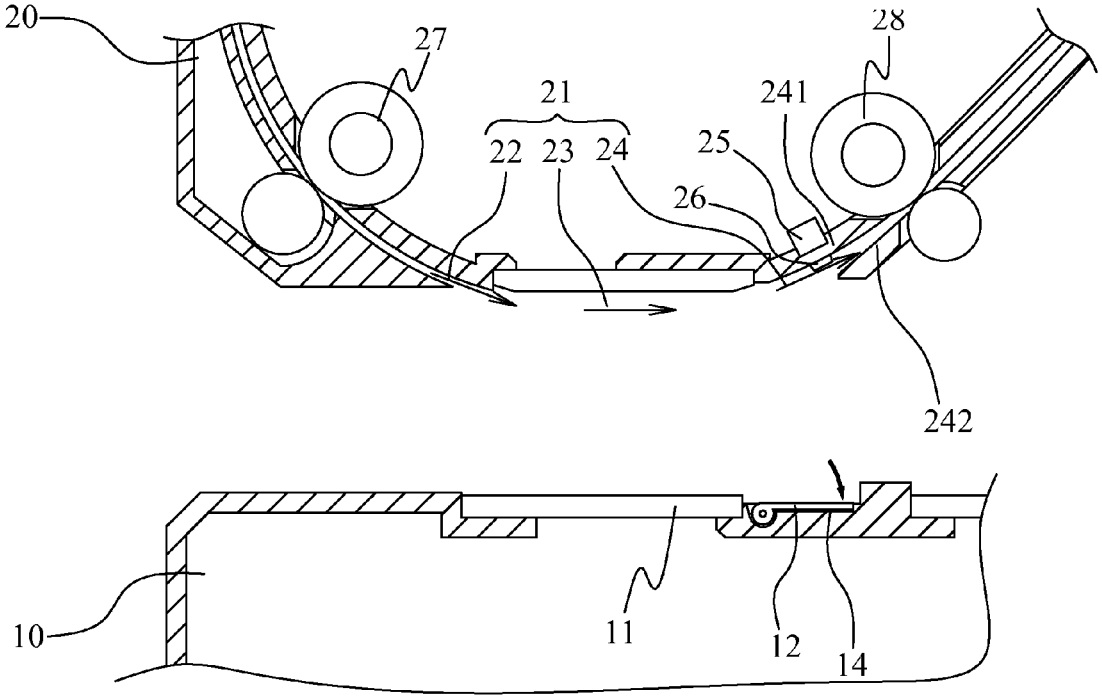
FIG. 10 is a partially sectional view of the office machine of FIG. 5, wherein the automatic document feeder is at the open position.

With reference to FIG. 5, FIG. 6 and FIG. 9, an office machine 100 according to an embodiment of this invention is capable of automatically transmitting a document 18 thereinto and out therefrom. The office machine 100 comprises a pedestal 10 and an automatic document feeder 20.

The pedestal 10 includes an image-handling unit 11 and a passage guider 12 made of magnetic material. The image-handling unit 11 is disposed in a top of the pedestal 10 and exposed out of a top face of the pedestal 10 for handling the document 18. The passage guider 12 is pivoted to the top face of the pedestal 10 and capable of rotating up and down in a predetermined range.

The automatic document feeder 20 is rotatably coupled with the pedestal 10 and capable of rotating between an open position exposing the image-handling unit 11 and a closed position covering the image-handling unit 11. The automatic document feeder 20 defines a passage 21 which includes an entering passage 22, an operating passage 23 and an exiting passage 24 connected in sequence from upstream to downstream according to the direction of transmitting the document 18 in the passage 21. The operating passage 23 is formed between the automatic document feeder 20 and the image-handling unit 11 of the pedestal 10. The automatic document feeder 20 further includes a feeding roller unit 27 arranged at two opposite sides of the entering passage 22, and a drawing-out roller unit 28 arranged at two opposite sides of the exiting passage 24 for contacting and transmitting the document 18 into and out of the automatic document feeder 20.

Referring to FIGS. 7-10, the automatic document feeder 20 further includes a magnetic component 25 mounted therein for driving the passage guider 12 by virtue of the magnetic action. A pivoted end of the passage guider 12 is pivoted near to a downstream side of the image-handling unit 11 of the pedestal 10, and a free end of the passage guider 12 is placed downstream to the pivoted end. When the automatic document feeder 20 is at the closed position, the passage guider 12 rotates upward according to the magnetic attraction of the magnetic component 25 to make the free end thereof project into the passage 21 and apart located between an upper inner sidewall 241 and a lower inner sidewall 242 of the entrance of the exiting passage 24 so as to guide the handled document 18 into the exiting passage 24.

When the automatic document feeder 20 is at the open position to set free the passage guider 12 from the magnetic component 25, the passage guider 12 rotates downward against the pedestal 10. Furthermore, a groove 14 is opened in the top face of the pedestal 10 and adjacent to the downstream side of the image-handling unit 11, so the passage guider 12 can be contained in the groove 14 when the automatic document feeder 20 is at the open position to set free the passage guider 12 from the magnetic component 25.

Figure 7:
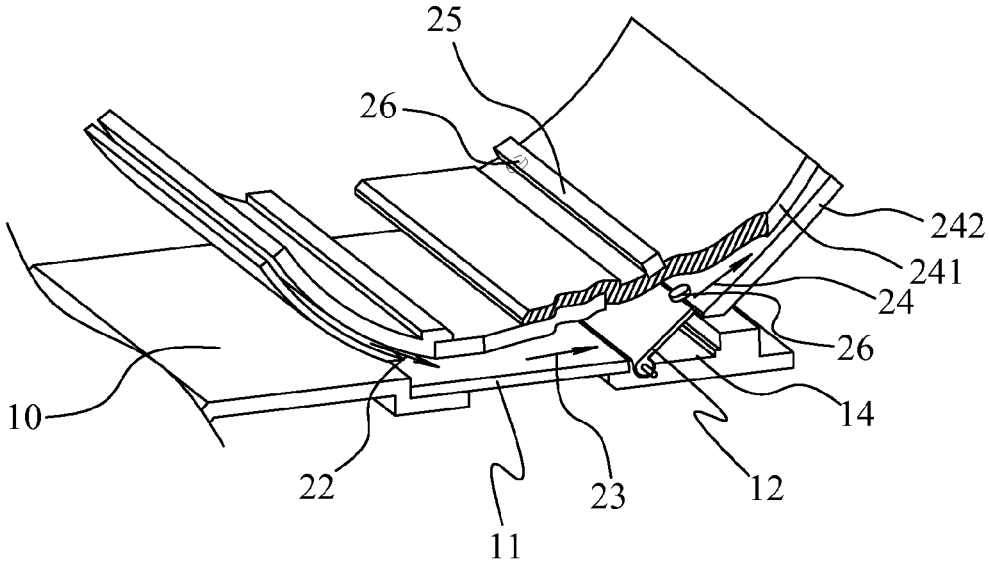
FIG. 7 and FIG. 8 are partially perspective views showing different embodiments of the office machine according to the present invention, wherein the automatic document feeder is at the closed position.
Figure 8:
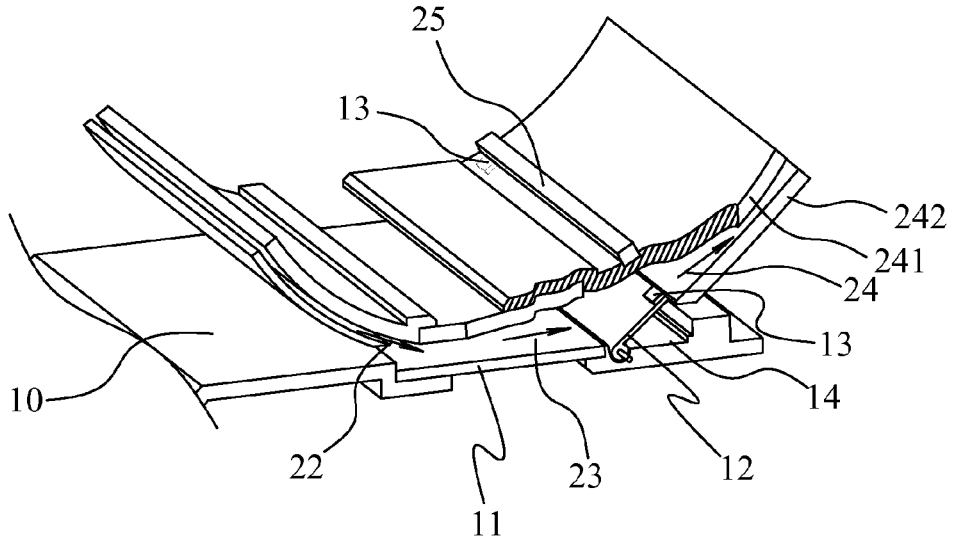

Referring to FIG. 7 and FIG. 8, they show two different embodiments of the office machine 100 according to the present invention. Referring to FIG. 7, in this embodiment, the automatic document feeder 20 further comprises two first limiting elements 26 protruded downward from the upper inner sidewall 241 of the entrance of the exiting passage 24 and located at two opposite sides of the passage 21. The first limiting elements 26 resist against the free end of the passage guider 12 for keeping a constant distance between the upper inner sidewall 241 of the entrance of the exiting passage 24 and the free end of the passage guider 12 when the automatic document feeder 20 is at the closed position. The constant distance is narrower than the exiting passage 24 in height and substantially fits in with the passage 21 in width for preventing the handled document 18 from being stuck by the first limiting elements 26.

Referring to FIG. 8, in this embodiment, the automatic document feeder 20 further comprises two second limiting elements 13 which are protruded upward on two ends of the free end of the passage guider 12. Therefore, when the automatic document feeder 20 is at closed position, the second limiting elements 13 in this embodiment will resist against the upper inner sidewall 241 for keeping a constant distance between the upper inner side wall 241 of the entrance of the exiting passage 24 and the free end of the passage guider 12. Similarly, the constant distance is narrower than the exiting passage 24 in height and substantially fits in with the passage 21 in width for preventing the handled document 18 from being stuck by the second limiting elements 13.

As described above, in use, the height of the passage guider 12 can be adjusted automatically according to the position of the automatic document feeder 20 by virtue of the magnetic attraction of the magnetic component 25, so as to ensure the free end of the passage guider 12 always apart between the upper inner sidewall 241 and the lower inner sidewall 242 of the entrance of the exiting passage 24. So, the document 18 can be guided into the exiting passage 24 smoothly by the passage guider 12.

What is claimed is:

1. An office machine capable of automatically transmitting a document thereinto and out therefrom, comprising:

a pedestal (10) including an image-handling unit (11) and a passage guider (12) made of magnetic material, the image-handling unit (11) being disposed in a top of the pedestal (10) and exposed out of a top face of the pedestal (10) for handling the document, the passage guider (12) being pivoted to the top face of the pedestal (10);

an automatic document feeder (20) rotatably coupled with the pedestal (10), capable of rotating between an open position exposing the image-handling unit (11) and a closed position covering the image-handling unit (11), the automatic document feeder (20) defining a passage (21) which includes an entering passage (22), an operating passage (23) and an exiting passage (24) connected in sequence from upstream to downstream according to the direction of transmitting the document in the passage (21), the operating passage (23) being formed between the automatic document feeder (20) and the image-handling unit (11), a magnetic component (25) being mounted to the automatic document feeder (20), wherein a pivoted end of the passage guider (12) is pivoted near to a downstream side of the image-handling unit (11), when the automatic document feeder (20) is at the closed position, the passage guider (12) rotates upward according to the magnetic attraction of the magnetic component (25) to make a free end thereof project into the passage (21) and apart located between an upper inner sidewall (241) and a lower inner sidewall (242) of the entrance of the exiting passage (24) so as to guide the handled document into the exiting passage (24), the passage guider (12) rotates downward against the pedestal (10) when the automatic document feeder (20) is at the open position to set free the passage guider (12) from the magnetic component (25).

2. The office machine as claimed in claim 1, wherein there is at least one first limiting element (26) protruded downward from the upper inner sidewall (241) of the entrance of the exiting passage (24), the first limiting element (26) resists against the free end of the passage guider (12) for keeping a constant distance between the upper inner sidewall (241) of the entrance of the exiting passage (24) and the free end of the passage guider (12) when the automatic document feeder (20) is at the closed position, the constant distance is narrower than the exiting passage (24) in height and substantially fits in with the passage (21) in width.

3. The office machine as claimed in claim 1, wherein there is at least one second limiting element (13) protruded upward on the free end of the passage guider (12), the second limiting element (13) resists against the upper inner sidewall (241) of the entrance of the exiting passage (24) for keeping a constant distance between the upper inner sidewall (241) of the entrance of the exiting passage (24) and the free end of the passage guider (12) when the automatic document feeder (20) is at the closed position, the constant distance is narrower than the exiting passage (24) in height and substantially fits in with the passage (21) in width.

4. The office machine as claimed in claim 1, wherein a groove (14) is opened in the top face of the pedestal (10) and near to the downstream side of the image-handling unit (11) for containing the passage guider (12) therein when the automatic document feeder (20) is at the open position to set free the passage guider (12) from the magnetic component (25).

5. The office machine as claimed in claim 1, wherein the automatic document feeder (20) further includes a feeding roller unit (27) arranged at two opposite sides of the entering passage (22), and a drawing-out roller unit (28) arranged at two opposite sides of the exiting passage (24) for transmitting the document into and out of the automatic document feeder (20).

* * * * *